US011408386B2

(12) United States Patent
Akiyama et al.

(10) Patent No.: US 11,408,386 B2
(45) Date of Patent: Aug. 9, 2022

(54) HIGH-PRESSURE FUEL PUMP

(71) Applicant: Hitachi Astemo, Ltd., Hitachinaka (JP)

(72) Inventors: Moritsugu Akiyama, Hitachinaka (JP); Kazuaki Tokumaru, Hitachinaka (JP); Hiroyuki Yamada, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 0 days.

(21) Appl. No.: 17/281,640

(22) PCT Filed: Sep. 12, 2019

(86) PCT No.: PCT/JP2019/035829
§ 371 (c)(1),
(2) Date: Mar. 31, 2021

(87) PCT Pub. No.: WO2020/071082
PCT Pub. Date: Apr. 9, 2020

(65) Prior Publication Data

US 2021/0372353 A1 Dec. 2, 2021

(30) Foreign Application Priority Data

Oct. 1, 2018 (JP) ..... JP2018-186334

(51) Int. Cl.
*F02M 55/04* (2006.01)
*F02M 59/44* (2006.01)
(Continued)

(52) U.S. Cl.
CPC ..... *F02M 55/04* (2013.01); *F02M 59/44* (2013.01); *F04B 11/0008* (2013.01); *F02M 59/36* (2013.01); *F02M 2200/315* (2013.01)

(58) Field of Classification Search
CPC ..... F02M 55/04; F02M 59/367; F02M 59/48; F04B 11/0016; F04B 11/0008
See application file for complete search history.

(56) References Cited

U.S. PATENT DOCUMENTS 8,662,868 B2 * 3/2014 Oikawa ..... F04B 37/12 417/540
9,074,593 B2 * 7/2015 Kobayashi ..... F04B 11/0008
(Continued)

FOREIGN PATENT DOCUMENTS

DE 10 2014 212 548 A1 12/2015
DE 102014212548 A1 * 12/2015 ..... F02M 55/04
(Continued)

OTHER PUBLICATIONS

International Search Report (PCT/ISA/210) issued in PCT Application No. PCT/JP2019/035829 dated Dec. 17, 2019 with English translation (five (5) pages).
(Continued)

*Primary Examiner* — Sizo B Vilakazi
*Assistant Examiner* — Brian R Kirby
(74) *Attorney, Agent, or Firm* — Crowell & Moring LLP

(57) ABSTRACT

To suppress the possibility that a body-side holding member comes into contact with a joint portion 92 of a damper mechanism 9. damper cover that is arranged on an upstream side of a pressurizing chamber and is attached to a body to form a damper chamber, a damper mechanism that is arranged in the damper chamber, and a body-side holding member that holds the damper mechanism from the body side are provided. The body-side holding member includes a bottom surface in contact with the body and a flexible portion formed along an urging direction by being urged downward from the damper cover toward the body.

13 Claims, 8 Drawing Sheets

(51) Int. Cl.
*F04B 11/00* (2006.01)
*F02M 59/36* (2006.01)

(56) References Cited

U.S. PATENT DOCUMENTS

2008/0289713 A1* 11/2008 Munakata ..... F02M 59/367 138/30
2009/0288639 A1* 11/2009 Usui ..... F04B 39/122 123/457
2010/0209274 A1* 8/2010 Oikawa ..... F04B 37/12 417/540
2012/0006303 A1* 1/2012 Usui ..... F02M 59/44 123/495
2013/0052064 A1* 2/2013 Oikawa ..... F04B 11/0016 417/540
2015/0132165 A1* 5/2015 Inoue ..... F02M 59/44 417/435
2016/0169173 A1* 6/2016 Yabuuchi ..... F02M 59/44 92/48
2018/0195478 A1* 7/2018 Iwa ..... F02M 55/04
2018/0274525 A1* 9/2018 Schretling ..... F04B 11/0008
2019/0063388 A1* 2/2019 Kurt ..... F02M 59/48

FOREIGN PATENT DOCUMENTS

DE 10 2015 214 812 A1 2/2017
JP 2008-286144 A 11/2008
JP 2009-264239 A 11/2009
JP 2016-79895 A 5/2016
WO WO 2017/148661 A1 9/2017

OTHER PUBLICATIONS

Japanese-language Written Opinion (PCT/ISA/237) issued in PCT Application No. PCT/JP2019/035829 dated Dec. 17, 2019 (seven (7) pages).

* cited by examiner

HIGH-PRESSURE FUEL PUMP

TECHNICAL FIELD

The present invention relates to a high-pressure fuel pump for an internal combustion engine.

BACKGROUND ART

In high-pressure fuel pumps, a pressure pulsation reduction mechanism for reducing pressure pulsation generated in the pump is housed in a damper chamber formed in a low-pressure fuel passage. Among the high-pressure fuel pumps equipped with a pressure pulsation reduction mechanism, there is a known device that reduces the number of parts during the work of assembling a metal diaphragm damper (metal damper) as a pressure pulsation reduction mechanism into the low-pressure fuel passage, and reduces parts shortage and incorrect assembly (for example, see PTL 1).

The high-pressure fuel pump described in PTL 1 includes a metal damper in which two disc-shaped metal diaphragms are joined over the entire circumference and a sealed space is formed inside the joint, and gas is enclosed in the sealed space of the damper. Further, a pair of pressing members for applying a pressing force to both outer surfaces of the metal damper at a position radially inward of the joint is provided. The pair of pressing members are combined into a unit while interposing the metal damper.

CITATION LIST

Patent Literature

PTL 1: JP 2009-264239 A

SUMMARY OF INVENTION

Technical Problem

In the high-pressure fuel pump described in PTL 1, in order to position the pair of pressing members (damper unit) holding the metal damper, it is necessary to process a part of the pump body, but the manufacturing cost increases accordingly. In order to reduce the manufacturing cost, if the shape of the holding member side is simplified, the upper and lower damper holding members are provided, and these are sandwiched between the damper cover and the body, there is a concern about that the damper holding member on the body side is deformed and comes into contact with the damper. If the damper holding member on the body side comes into contact with the metal damper, a large load may be applied to the metal damper.

The present invention has been made to solve the above problems, and an object of the present invention is to provide a high-pressure fuel pump capable of suppressing radial deformation of a body-side damper holding member particularly during assembly.

Solution to Problem

The present application includes a plurality of means for solving the above problems. For example, a damper cover that is arranged on an upstream side of a pressurizing chamber and is attached to a body to form a damper chamber, a damper mechanism that is arranged in the damper chamber, and a body-side holding member that holds the damper mechanism from the body side are provided. The body-side holding member includes a bottom surface in contact with the body and a flexible portion formed along an urging direction by being urged downward from the damper cover toward the body.

Advantageous Effects of Invention

According to the present invention, it is possible to provide a high-pressure fuel pump capable of suppressing radial deformation of the body-side damper holding member particularly during assembly.

Objects, configurations, and effects besides the above description will be apparent through the explanation on the following embodiments.

DESCRIPTION OF EMBODIMENTS

Figure 1:
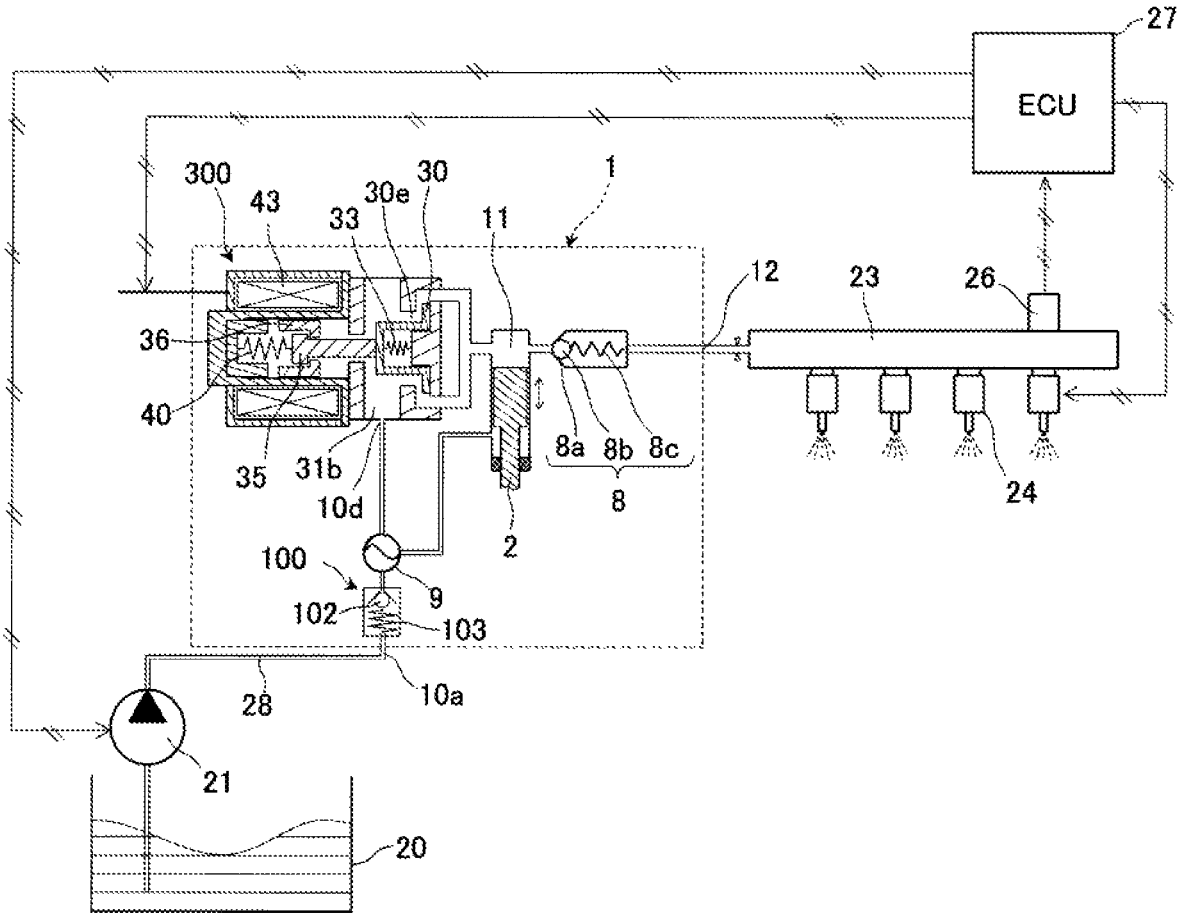
FIG. 1 is a configuration diagram illustrating a fuel supply system for an internal combustion engine including a high-pressure fuel pump according to a first embodiment of the invention.

Hereinafter, embodiments of a high-pressure fuel pump of the invention will be described with reference to the drawings. Further, the same symbols in the drawings indicate the same portion.

Fuel Supply System

FIG. 1 is a configuration diagram illustrating a fuel supply system of an internal combustion engine including a high-pressure fuel pump (high-pressure fuel supply pump) of this embodiment. In FIG. 1, a portion surrounded by a broken line indicates a body 1 (pump body) which is a main body of the high-pressure fuel pump. The mechanisms and components illustrated in the broken line indicate that they are incorporated in the body 1.

In FIG. 1, the fuel supply system includes a fuel tank 20 for storing fuel, a feed pump 21 for pumping up and sending out the fuel in the fuel tank 20, a high-pressure fuel pump for pressurizing and discharging a low-pressured fuel sent from the feed pump 21, and a plurality of injectors 24 for injecting the high-pressure fuel pumped from the high-pressure fuel pump. The high-pressure fuel pump is connected to the feed pump 21 via a suction pipe 28. The high-pressure fuel pump pumps fuel to the injector 24 via a common rail 23. The injector 24 is mounted on the common rail 23 according to the number of cylinders of the engine. A pressure sensor 26 is mounted on the common rail 23 to detect the pressure of the fuel discharged from the high-pressure fuel pump.

This high-pressure fuel pump is applied to a so-called direct injection engine system in which the injector 24 directly injects fuel into a cylinder of an engine as an internal combustion engine. The high-pressure fuel pump includes a pressurizing chamber 11 for pressurizing the fuel, an electromagnetic suction valve mechanism 300 as a variable capacity mechanism for adjusting the amount of fuel sucked into the pressurizing chamber 11, a plunger 2 for pressurizing the fuel in the pressurizing chamber 11 by reciprocating motion, and a discharge valve mechanism 8 for discharging the fuel pressurized by the plunger. On the upstream side of the electromagnetic suction valve mechanism 300, a damper mechanism 9 (metal damper) is provided as a pressure pulsation reduction mechanism for reducing the pressure pulsation generated in the high-pressure fuel pump from spreading to the suction pipe 28.

The feed pump 21, the electromagnetic suction valve mechanism 300, and the injector 24 are controlled by a control signal output from an engine control unit (hereinafter, referred to as an ECU) 27. The detection signal of the pressure sensor 26 is input to the ECU 27.

The fuel in the fuel tank 20 is pressurized to an appropriate feed pressure by the feed pump 21 driven based on the control signal of the ECU 27 and sent to a low-pressure fuel suction port 10*a* of the high-pressure fuel pump through the suction pipe 28. The fuel that has passed through the low-pressure fuel suction port 10*a* reaches a suction port 31*b* of the electromagnetic suction valve mechanism 300 via the damper mechanism 9 and a suction passage 10*d*. The fuel that has passed through a suction valve 30 is sucked into the pressurizing chamber 11 during a downward stroke of the plunger 2, and is pressurized in the pressurizing chamber 11 during an upward stroke of the plunger 2. The pressurized fuel is pumped to the common rail 23 via the discharge valve mechanism 8. The high-pressure fuel in the common rail 23 is injected into the cylinder of the engine by the injector 24 driven based on the control signal of the ECU 27. In addition to the damper mechanism 9 (pressure pulsation reduction mechanism), the high-pressure fuel pump illustrated in FIG. 1 includes a pressure pulsation propagation prevention mechanism 100 on the upstream side of the damper mechanism. The pressure pulsation propagation prevention mechanism 100 includes a valve seat (not illustrated), a valve 102 that comes into contact with and separates from the valve seat, a spring 103 that urges the valve 102 toward the valve seat, and a spring stopper (not illustrated) that limits the stroke of the valve 102. Further, the pressure pulsation propagation prevention mechanism 100 is not illustrated in drawings other than FIG. 1.

High-Pressure Fuel Pump

Next, the configuration of each part of the high-pressure fuel pump will be described with reference to FIGS. 2 to 5.

Figure 2:
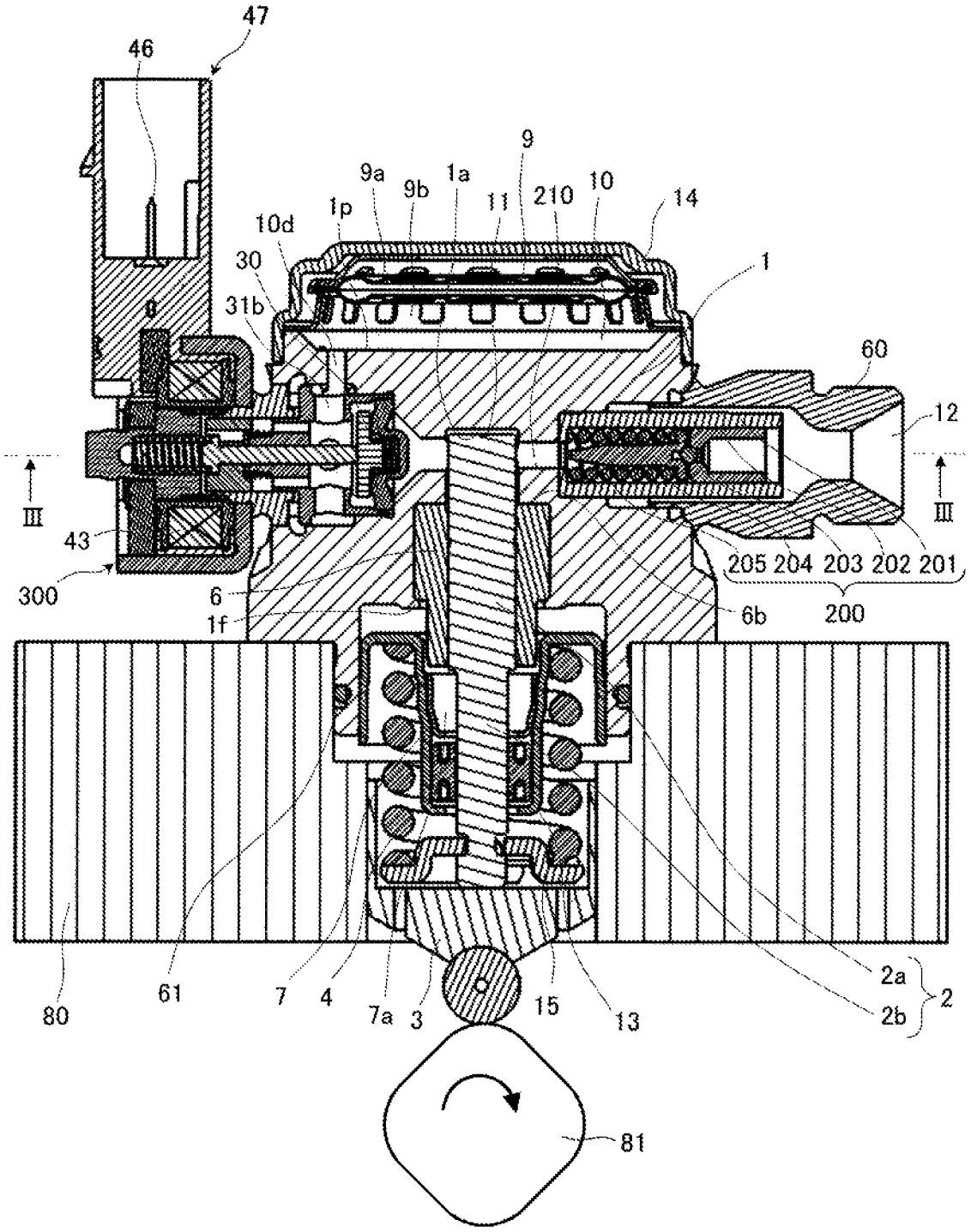
FIG. 2 is a longitudinal cross-sectional view illustrating the high-pressure fuel pump according to the first embodiment of the invention.
Figure 3:
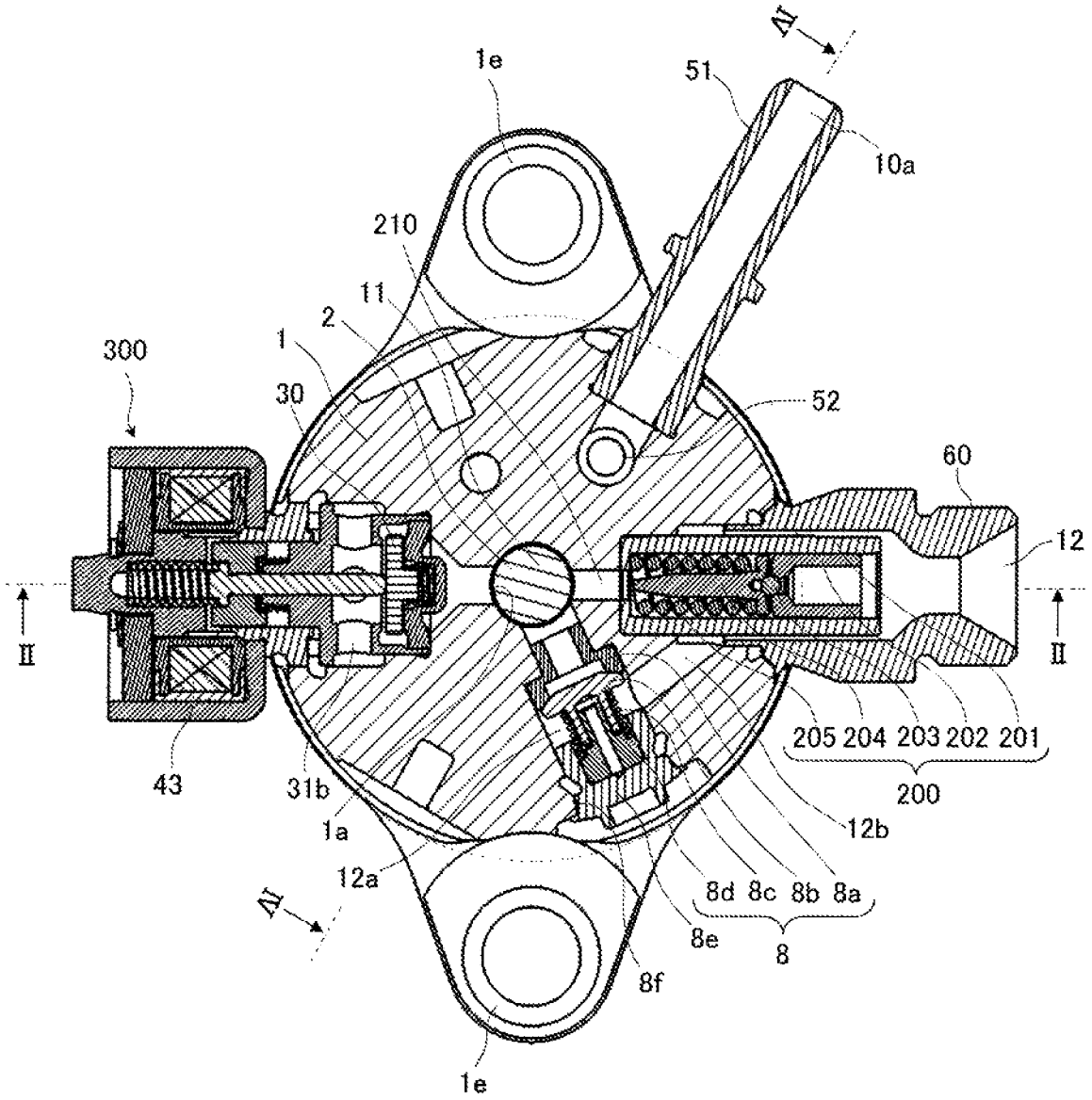
FIG. 3 is a lateral cross-sectional view of the high-pressure fuel pump according to the first embodiment of the invention illustrated in FIG. 2, as viewed from the direction of arrows III-III.
Figure 4:
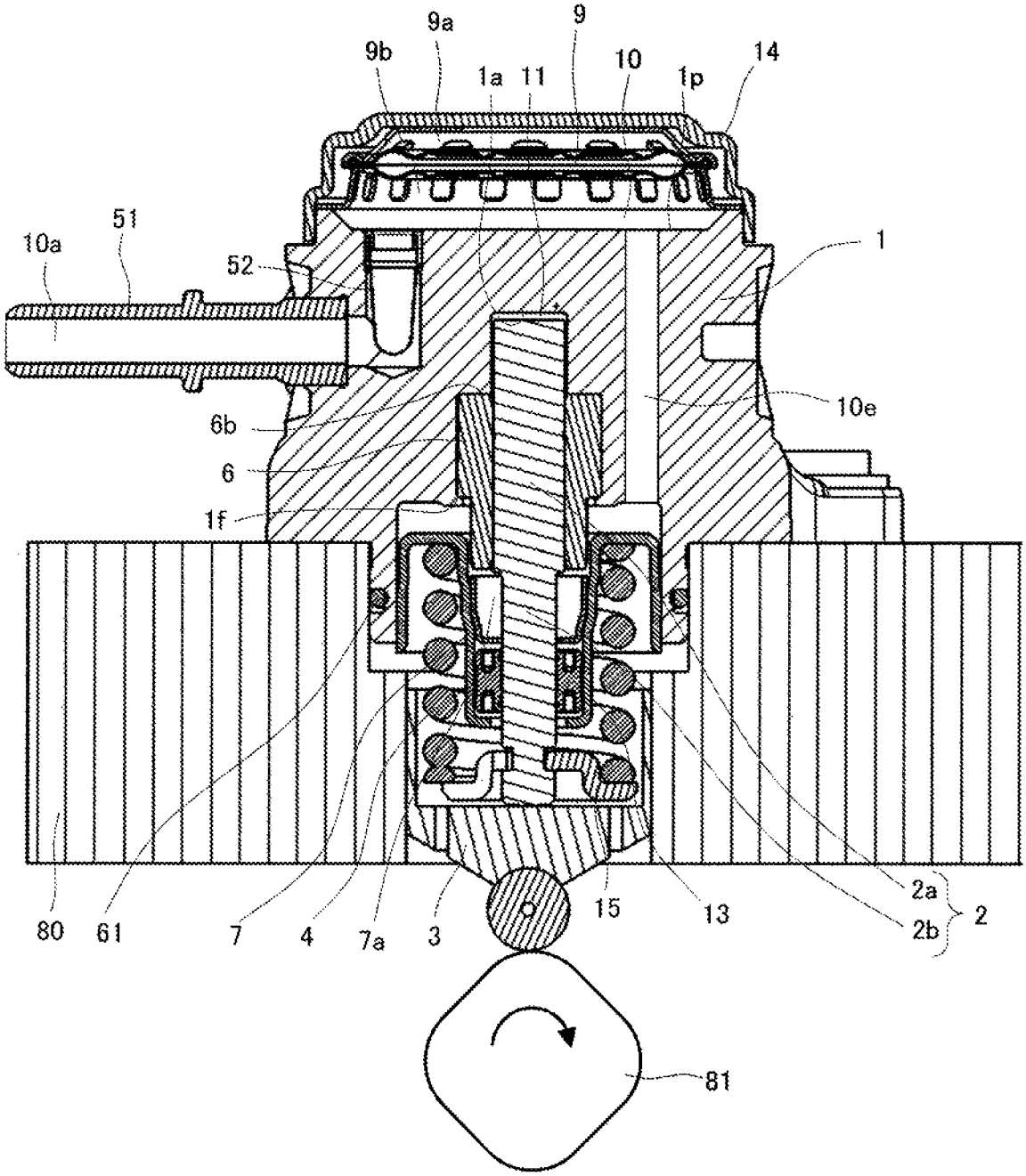
FIG. 4 is a longitudinal cross-sectional view illustrating a state in which the high-pressure fuel pump according to the first embodiment of the invention is cut along a plane (a plane different from FIG. 1) including both axes of a plunger and a suction joint.
Figure 5:
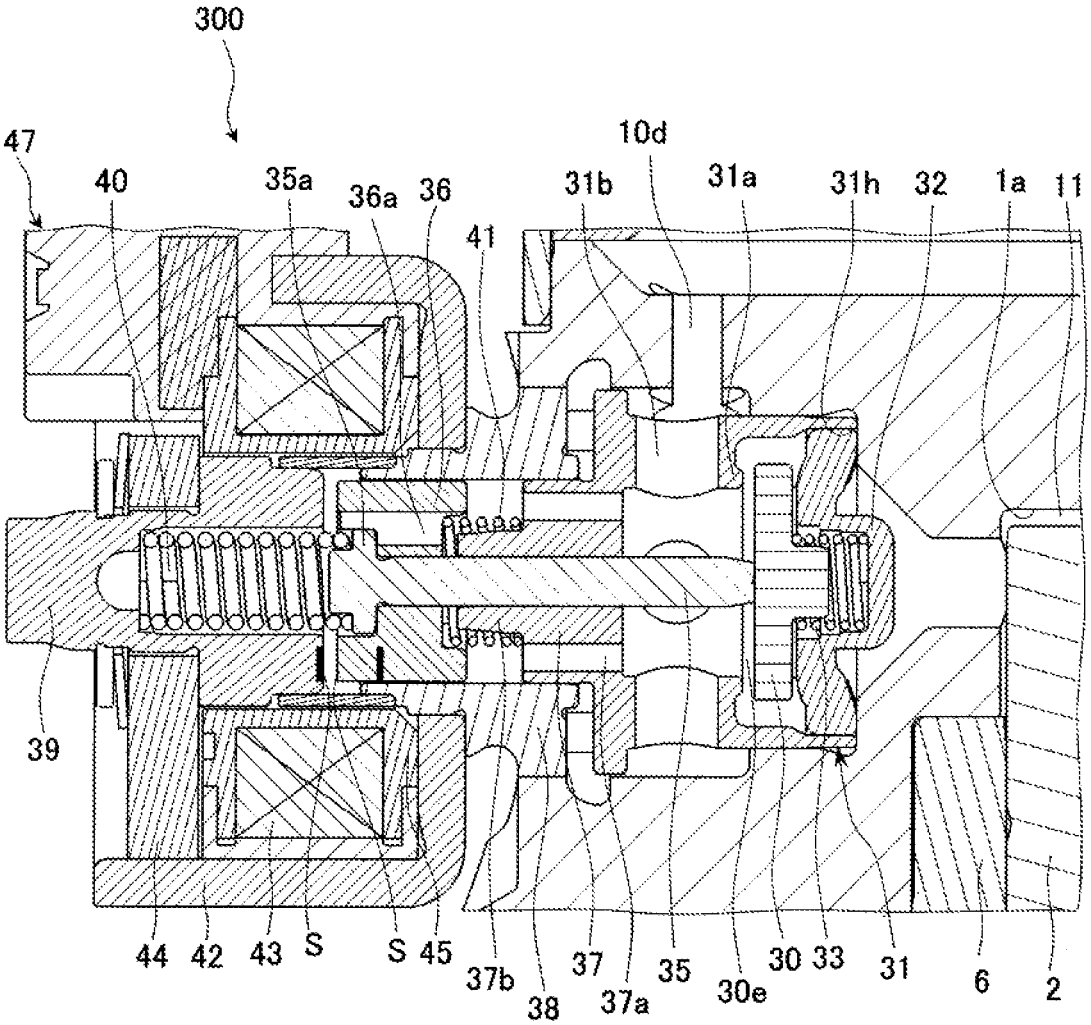
FIG. 5 is a longitudinal cross-sectional view illustrating an enlarged state of an electromagnetic suction valve mechanism that forms a part of the high-pressure fuel pump according to the first embodiment of the invention.

FIG. 2 is a longitudinal cross-sectional view illustrating a high-pressure fuel pump according to this embodiment. FIG. 3 is a lateral cross-sectional view of the high-pressure fuel pump illustrated in FIG. 2 as viewed from the arrow III-III. FIG. 4 is a longitudinal cross-sectional view illustrating a state in which the high-pressure fuel pump is cut along a plane (a plane different from FIG. 1) including both the axes of the plunger and the suction joint. FIG. 5 is a longitudinal cross-sectional view illustrating an enlarged state of the electromagnetic suction valve mechanism that constitutes a part of the high-pressure fuel pump. Further, in FIG. 5, a part of the connector is omitted, and the electromagnetic suction valve mechanism is illustrated in an open state.

In FIG. 2, the high-pressure fuel pump includes a body 1 having the pressurizing chamber 11 therein, the plunger 2 mounted on the body 1, the electromagnetic suction valve mechanism 300, the discharge valve mechanism 8 (see FIG. 3), a relief valve mechanism 200, and the damper mechanism 9 as a pressure pulsation reduction mechanism. The high-pressure fuel pump is in close contact with a pump mounting portion 80 of the engine using a mounting flange 1*e* (see FIG. 3) provided at one end of the body 1, and is fixed with a plurality of bolts (not illustrated). An O-ring 61 is fitted on the outer peripheral surface of the body 1 fitted with the pump mounting portion 80. The O-ring 61 seals between the pump mounting portion 80 and the body 1, and prevents engine oil and the like from leaking out of the engine.

As illustrated in FIGS. 2 and 4, the body 1 is provided with a bottomed, stepped first accommodation hole 1*a*. A cylinder 6 for guiding the reciprocating motion of the plunger is press-fitted into the middle diameter portion of the first accommodation hole 1*a* on the outer peripheral side thereof, and forms a part of the pressurizing chamber 11 together with the body 1. The cylinder 6 is pressed toward the pressurizing chamber 11 by a fixing portion if in which a part of the body 1 is deformed to the inner peripheral side, and an end surface 6*b* on the pressurizing chamber 11 side (the upper side in FIGS. 2 and 4) is pressed against the wall surface of the first accommodation hole 1*a* of the body 1, so that the fuel pressurized in the pressurizing chamber 11 is sealed not to leak to the low pressure side.

The plunger 2 has a large-diameter portion 2*a* that slides on the cylinder 6, and a small-diameter portion 2*b* that extends from the large-diameter portion 2*a* to the side opposite to the pressurizing chamber 11. A tappet 3 is provided on the tip side (the lower end side in FIGS. 2 and 4) of the small-diameter portion 2*b* of the plunger 2. The tappet 3 converts the rotational motion of a cam 81 (cam mechanism) attached to a cam shaft (not illustrated) of the engine into a linear reciprocating motion and transmits the motion to the plunger 2. The plunger 2 is pressed against the tappet 3 by the urging force of a spring 4 via a retainer 15.

A seal holder 7 is press-fitted and fixed to the large-diameter portion of the first accommodation hole 1*a* of the body 1. Inside the seal holder 7, there is formed a sub-chamber 7*a* for storing the fuel leaking from the pressurizing chamber 11 via a sliding portion between the plunger 2 and the cylinder 6.

A plunger seal 13 is provided on the small-diameter portion 2*b* of the plunger 2. The plunger seal 13 is held at the inner peripheral end of the seal holder 7 on the cam 81 side so as to be able to slide on the outer peripheral surface of the small-diameter portion 2*b*. The plunger seal 13 seals the fuel in the sub-chamber 7*a* and prevents the fuel from flowing into the engine when the plunger 2 reciprocates. At the same time, the lubricating oil (including the engine oil) in the engine is prevented from flowing into the body 1 from the engine side.

In addition, as illustrated in FIGS. 3 and 4, a suction joint 51 is attached to a side surface of the body 1. The suction pipe 28 (see FIG. 1) is connected to the suction joint 51, and the fuel from the fuel tank 20 is supplied to the inside of the high-pressure fuel pump through the low-pressure fuel suction port 10*a* of the suction joint 51. A suction filter 52 is attached downstream of the low-pressure fuel suction port 10*a*.

As illustrated in FIGS. 2 and 3, the body 1 is provided with an electromagnetic suction valve mechanism 300 for supplying fuel to the pressurizing chamber 11. As illustrated in FIG. 5, the structure of the electromagnetic suction valve mechanism 300 is roughly classified into a suction valve portion mainly configured by the suction valve 30, a solenoid mechanism mainly configured by a rod 35 and an anchor portion 36, and a coil portion mainly configured by an electromagnetic coil 43.

The suction valve portion includes the suction valve 30, a suction valve housing 31, a suction valve stopper 32, and a suction valve urging spring 33. The suction valve housing 31 includes, for example, a cylindrical valve housing portion 31*h* that houses the suction valve 30 on one side (the right side in FIG. 5), and an annular suction valve seat portion 31*a* that protrudes on the inner peripheral side of the valve housing portion 31*h*. The suction valve housing 31 is formed integrally with a rod guide 37 described later. The suction valve housing 31 is provided with a plurality of suction ports 31*b* radially communicating with the suction passage (low-pressure fuel flow path) 10*d*. The suction valve stopper 32 is press-fitted and fixed to the valve housing portion 31*h*. The suction valve 30 closes by abutting on the suction valve seat portion 31*a*, and abuts on the suction valve stopper 32 when the valve is open. The suction valve urging spring 33 is disposed between the suction valve 30 and the suction valve stopper 32, and urges the suction valve 30 in the valve closing direction.

The solenoid mechanism includes the rod 35 and the anchor portion 36 that are movable parts, the rod guide 37, an outer core 38, and a fixed core 39 that are fixing portion, a rod urging spring 40, and an anchor portion urging spring 41.

The rod 35 is slidably held in the axial direction on the inner peripheral side of the rod guide 37. The rod 35 has a tip end on one side (the right side in FIG. 5) that can be brought into contact with and separated from the suction valve 30, and has a rod flange 35*a* at an end on the other side (the left side in FIG. 5). The inner peripheral side of the anchor portion 36 slidably holds the rod 35. The anchor portion 36 has a through hole 36*a* penetrating in the axial direction.

The rod guide 37 has a cylindrical central bearing portion 37*b*, and guides the reciprocating operation of the rod 35. The rod guide 37 is provided with a through hole 37*a* penetrating in the axial direction. The rod guide 37 is press-fitted on the inner peripheral side of one side (the right side in FIG. 5) of the outer core 38 in the axial direction. The anchor portion 36 is slidably disposed on the inner peripheral side on the other side in the axial direction (the left side in FIG. 5). The fixed core 39 is disposed such that the end surface on one side (the right side in FIG. 5) faces the end surface on the rod flange 35*a* side of the anchor portion 36. One end surface of the fixed core 39 and the end surface of the anchor portion 36 facing the one end surface form a magnetic attraction surface S which a magnetic attraction force acts therebetween. When the suction valves 30 are in the open state, they face each other via a magnetic gap.

The rod urging spring 40 between the fixed core 39 and rod flange 35*a* applies an urging force in the valve opening direction of the suction valve 30, and is set so as to be an urging force for keeping the suction valve 30 open when the electromagnetic coil 43 is not energized. One end of the anchor portion urging spring 41 is inserted into the central bearing portion 37*b* of the rod guide 37, and applies an urging force to the anchor portion 36 toward the rod flange 35*a*.

The coil portion includes a first yoke 42, the electromagnetic coil 43, a second yoke 44, a bobbin 45, and a connector 47 having a terminal 46 (see FIG. 2). The electromagnetic coil 43 is formed by winding a copper wire around the outer periphery of the bobbin 45, and is assembled on the outer peripheral side of the fixed core 39 and the outer core 38 in a state surrounded by the first yoke 42 and the second yoke 44. The first yoke 42 has its hole fixed to the outer peripheral side of the outer core 38. The second yoke 44 is configured such that the outer peripheral side is fixed to the inner peripheral side of the first yoke 42, and the inner peripheral side is close to the outer periphery of the fixed core 39 with a clearance.

In the magnetic circuit formed by the outer core 38, the first yoke 42, the second yoke 44, the fixed core 39, and the anchor portion 36, a magnetic attraction force is generated between the fixed core 39 and the anchor portion 36 when a current is applied to the electromagnetic coil 43.

Further, the discharge valve mechanism 8 (FIG. 3) on the outlet side of the pressurizing chamber 11 of the body 1 is configured by a discharge valve seat 8*a*, a discharge valve 8*b* which comes into contact with or separates from the discharge valve seat 8*a*, a discharge valve spring 8*c* which urges the discharge valve 8*b* toward the discharge valve seat 8*a*, and a discharge valve stopper 8*d* which determines a stroke (moving distance) of the discharge valve 8*b*. The discharge valve stopper 8*d* is held by a plug 8*e*. The plug 8*e* is joined to the body 1 by welding at the contact portion 8*f*. A discharge valve chamber 12*a* is formed on the secondary side of the discharge valve 8*b*.

When the fuel pressure of the pressurizing chamber 11 becomes larger than that of the discharge valve chamber 12*a*, first the discharge valve 8*b* is opened against the urging force of the discharge valve spring 8*c*. When the discharge valve 8*b* is opened, the high-pressure fuel in the pressurizing chamber 11 is discharged to the common rail 23 (see FIG. 1) through the discharge valve chamber 12*a*, a fuel discharge passage 12*b* described below, and a fuel discharge port 12. With the above configuration, the discharge valve mechanism 8 functions as a check valve that restricts the direction of fuel flow.

Further, the pressurizing chamber 11 is configured by the body 1, the electromagnetic suction valve mechanism 300, the plunger 2, the cylinder 6, and the discharge valve mechanism 8.

In addition, as illustrated in FIGS. 2 and 3, a discharge joint 60 is attached to the body 1 at a position opposite to the electromagnetic suction valve mechanism 300. The discharge joint 60 has the fuel discharge port 12 formed therein, and the fuel discharge port 12 communicates with the discharge valve chamber 12*a* via the fuel discharge passage 12*b*. The discharge joint 60 is configured to house the relief valve mechanism 200 therein.

The relief valve mechanism 200 includes a relief body 201, a relief valve seat 202, a relief valve 203, a relief valve holder 204, and a relief spring 205. After the relief spring 205, the relief valve holder 204, and the relief valve 203 are inserted in this order in the relief body 201, the relief valve seat 202 is press-fitted and fixed. One end of the relief spring 205 is in contact with the relief body 201, and the other end is in contact with the relief valve holder 204. The relief valve 203 shuts off the fuel by the urging force of the relief spring 204 acting via the relief valve holder 204 and being pressed by the relief valve seat 202. The valve opening pressure of the relief valve 203 is determined by the urging force of the relief spring 205. The relief valve mechanism 200 communicates with the pressurizing chamber 11 via a relief passage 210.

In addition, as illustrated in FIGS. 2 and 4, a concave portion 1*p* is provided on the tip end side (the upper end side in FIGS. 2 and 4) of the body 1. A cylindrical-bottomed damper cover 14 (cup shape) is fixed to the body 1 by welding so as to cover the concave portion 1*p*. A damper chamber 10 (low-pressure fuel chamber) is formed by the concave portion 1*p* of the body 1 and the damper cover 14. The damper chamber communicates with the low-pressure fuel suction port 10*a* and also communicates with the suction port 31*b* of the electromagnetic suction valve mechanism 300 via the suction passage 10*d*. That is, the damper chamber 10 is formed upstream of the pressurizing chamber 11. In addition, the damper chamber 10 communicates with the sub-chamber 7*a* via a fuel passage 10*e*.

The damper mechanism 9 is arranged in the damper chamber 10. That is, the body 1 and the damper cover 14 form the damper chamber 10 in which the damper mechanism 9 is arranged. The damper mechanism 9 is held inside the damper chamber 10 in the state of being sandwiched between a cover-side holding member 9*a* (first holding member) for holding the damper mechanism 9 from the damper cover 14 side (upper side) and a body-side holding member 9*b* (second holding member) for holding the damper mechanism 9 from the body 1 side (lower side). The cover-side holding member 9*a* is arranged between the damper cover 14 and the damper mechanism 9 in the damper chamber 10, and presses and holds the damper mechanism 9 from one side (the upper side in FIGS. 2 and 4). The body-side holding member 9*b* is arranged on the opposite side of the cover-side holding member 9*a* with the damper mechanism 9 sandwiched therebetween in the damper chamber 10. That is, the body-side holding member 9*b* is arranged between the body 1 and the damper mechanism 9, and holds the damper mechanism 9 by pressing it from the other side (lower side in FIGS. 2 and 4).

Details of Damper Mechanism and Holding Structure of Damper Mechanism

Figure 6:
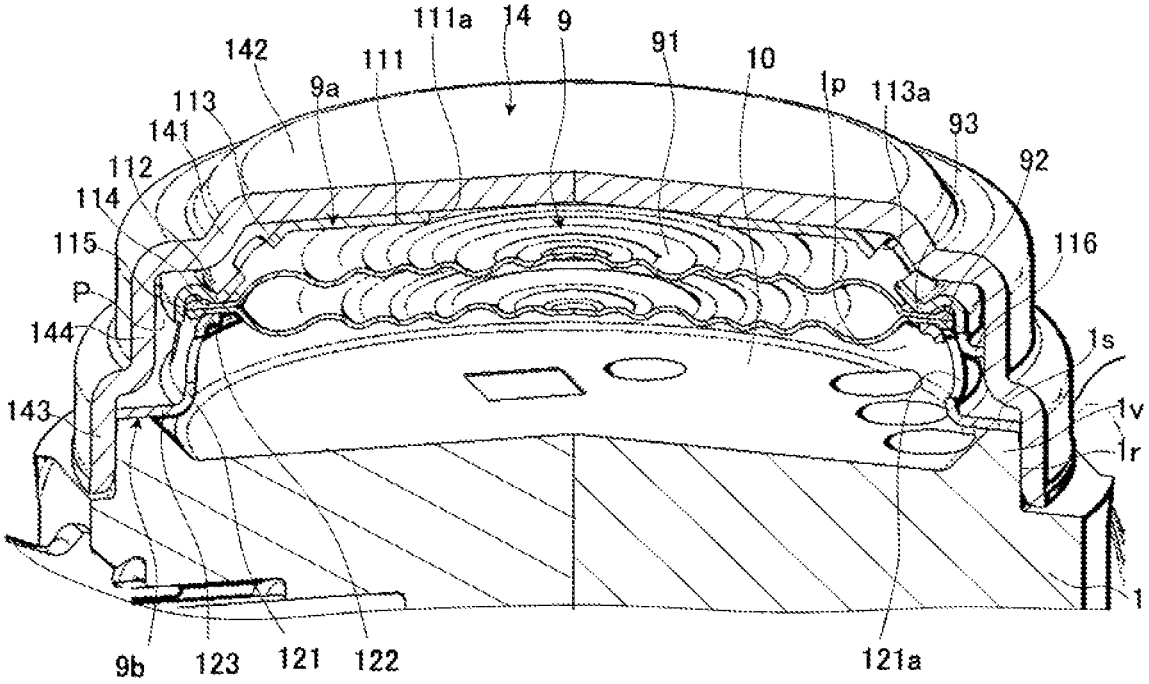
FIG. 6 is an enlarged perspective view illustrating a cut-away state of a metal damper and a holding structure thereof that form a part of the high-pressure fuel pump according to the first embodiment of the invention.
Figure 7:
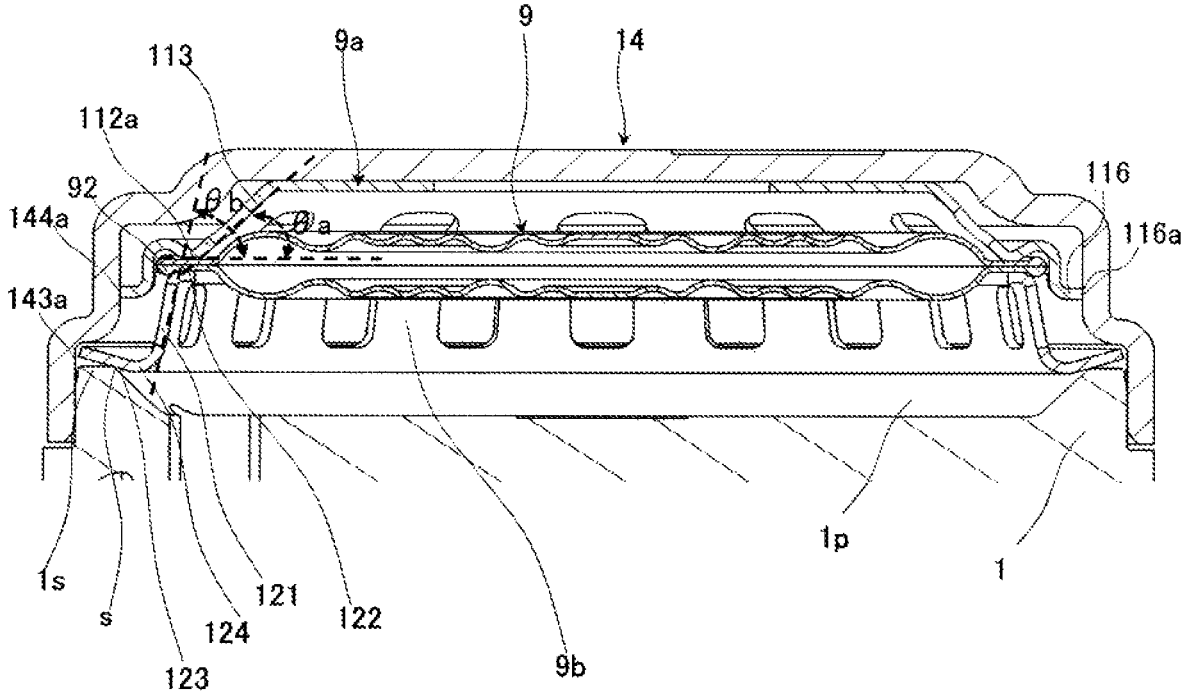
FIG. 7 is a cross-sectional view illustrating a body-side holding member after compression (after pressing) which forms a part of the high-pressure fuel pump according to the first embodiment of the invention illustrated in FIG. 6.
Figure 8:
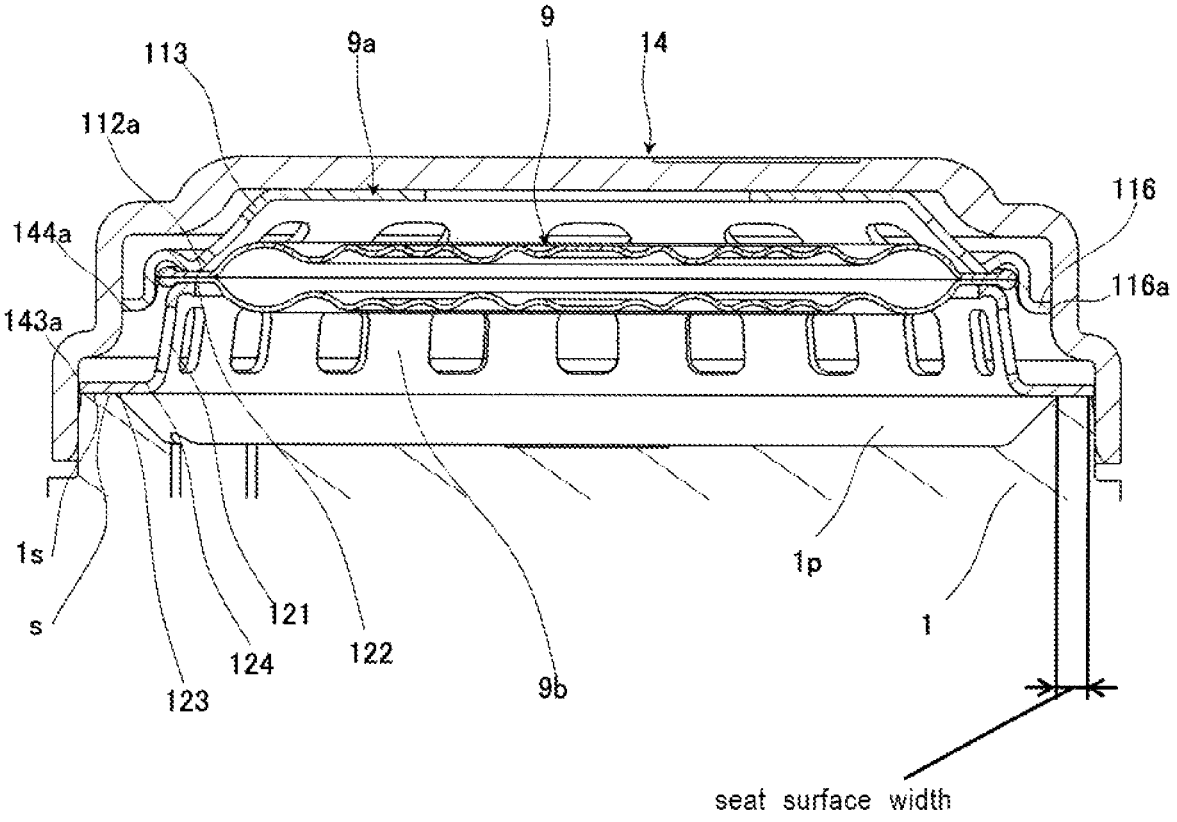
FIG. 8 is a cross-sectional view illustrating the body-side holding member before compression (before pressing) which forms a part of the high-pressure fuel pump according to the first embodiment of the invention illustrated in FIG. 6.

Next, the details of the damper mechanism 9 and the configuration and structure of parts for holding the damper mechanism 9 will be described with reference to FIGS. 6 and 7. FIG. 6 is an enlarged perspective view illustrating the damper mechanism and its holding structure in a cut state. FIG. 7 is a cross-sectional view illustrating the body-side holding member 9*b* of this embodiment after compression (after pressing). FIG. 8 is a cross-sectional view illustrating the body-side holding member 9*b* forming a part of the high-pressure fuel pump illustrated in FIG. 6 before compression (before pressing).

In FIG. 6, for example, the damper mechanism 9 is formed by welding all over the periphery of two corrugated disk-shaped metal diaphragms at their peripheral edges, and sealing an inert gas such as argon to an internal space formed between the two laminated diaphragms. The damper mechanism 9 is configured by a substantially circular main body portion 91 having an internal space in which an inert gas is sealed, a welding portion 92 formed in a peripheral portion, and an annular and flat plate portion 93 extending between the main body portion 91 and the welding portion 92. The flat plate portion 93 is a portion where the planar portions of the two metal diaphragms overlap, and is located radially inward of the welding portion 92. The damper mechanism 9 reduces pressure pulsation by increasing or decreasing the volume of the internal space of the main body portion 91 due to pressure acting on both surfaces.

The concave portion 1*p* of the body 1 is formed in a truncated cone shape whose diameter on the opening side is enlarged. At the end of the body 1 on the concave portion 1*p* side, an outer peripheral surface 1*r* is formed in a cylindrical shape, and an end surface 1*s* is formed in an annular shape. In other words, an annular protrusion 1*v* is formed at the end of the body 1 on the concave portion 1*p* side. The end of the body 1 on the side of the concave portion 1*p* and the concave portion 1*p* have a rotationally symmetric shape.

The damper cover 14, for example, is formed in a stepped cylindrical shape (cup shape) with one side closed and is formed in a rotationally symmetric shape, and is configured to accommodate three components: the cover-side holding member 9*a*, the damper mechanism 9, and the body-side holding member 9*b*. Specifically, the damper cover 14 is configured by a cylindrical small-diameter cylindrical portion 141, a circular closing portion 142 that closes one side of the small-diameter cylindrical portion 141, a cylindrical large-diameter cylindrical portion 143 on the opening side, and a cylindrical medium-diameter cylindrical portion 144 located between the small-diameter cylindrical portion 141 and the large-diameter cylindrical portion 143.

The damper cover 14 is formed, for example, by pressing a steel plate. The large-diameter cylindrical portion 143 of the damper cover 14 is press-fitted into the outer peripheral surface 1*r* at the end of the body 1 on the concave portion 1*p* side and fixed by welding. The damper cover 14 is arranged on the upstream side of the pressurizing chamber 11 and is attached to the body 1 to form a damper chamber. By providing a plurality of steps in the cylindrical portion of the damper cover 14, the tip end (small-diameter cylindrical portion 141) can be reduced in size with respect to the portion (large-diameter cylindrical portion 143) attached to the body 1, and this is advantageous when the installation space for the high-pressure fuel pump is narrow.

The cover-side holding member 9*a* is, for example, an elastic body having a bottomed cylindrical shape (cup shape) and rotationally symmetrical shape as illustrated in FIG. 6. Specifically, the cover-side holding member 9*a* includes a contact portion 111 that abuts on the damper cover 14, an annular pressing portion 112 that presses the flat plate portion 93 of the damper mechanism 9 over the entire circumference, a cylindrical first side wall surface portion 113 which connects the contact portion 111 and the pressing portion 112 and increases its diameter from the contact portion 111 toward the pressing portion 112, an annular curved portion 114 that protrudes radially outward from the entire periphery of the pressing portion 112 to be bent to receive a part of the welding portion 92 of the damper mechanism 9, and a cylindrical enclosing portion 115 that extends in the axial direction from the curved portion 114 and surrounds the peripheral edge of the damper mechanism 9. The cover-side holding member 9*a* is formed, for example, by pressing a steel plate.

The contact portion 111 is formed in a circular and planar shape. A first communication hole 111*a* is provided at the center of the contact portion 111. The invention may have a configuration in which the first communication hole 111*a* is not provided.

In the first side wall surface portion 113, a plurality of second communication holes 113*a* are provided at intervals in the circumferential direction. The second communication hole 113*a* is a communication passage that communicates with a space (a space surrounded by the cover-side holding member 9*a* and the damper mechanism 9) formed radially inside the cylindrical first side wall surface portion 113 and a space (a space surrounded by the cover-side holding member 9*a* and the damper cover 14) formed outside in the radial direction of the first side wall surface portion 113, and functions as a flow path that allows the fuel inside the damper chamber 10 to circulate to both surfaces of the main body portion 91 of the damper mechanism 9.

The enclosing portion 115 is set so that the inner diameter thereof has a gap (first gap) within a predetermined range than the outer diameter of the damper mechanism 9, and functions as a first regulation portion that regulates movement of the damper mechanism 9 in the radial direction. The first gap between the inner peripheral surface of the enclosing portion 115 and the peripheral edge of the damper mechanism 9 is set in a range where the pressing portion 112 of the cover-side holding member 9*a* does not abut on the welding portion 92 of the damper mechanism 9 even if the damper mechanism 9 is radially displaced from the cover-side holding member 9*a* by the first gap.

A plurality of projections 116 projecting outward in the radial direction are provided at the opening-side end of the enclosing portion 115 at intervals in the circumferential direction. The plurality of projections 116 are configured to face the inner peripheral surface of the medium-diameter cylindrical portion 144 of the damper cover 14 with a gap (second gap) within a predetermined range, and functions as a second regulation portion that regulates movement of the cover-side holding member 9*a* in the radial direction in the damper chamber 10. In other words, the plurality of projections 116 have a function of centering the cover-side holding member 9*a* in the damper cover 14. In order to sufficiently exhibit the centering function, it is desirable to provide six or more projections 116. The second gap between the tip of each projection 116 and the inner peripheral surface of the medium-diameter cylindrical portion 144 of the damper cover 14 is set in a range where the pressing portion 112 of the cover-side holding member 9*a* does not abut on the welding portion 92 of the damper mechanism 9 even if the cover-side holding member 9*a* is displaced in the radial direction with respect to the damper cover 14 by the second gap.

Each projection 116 is formed, for example, by cutting and raising, and a space P extending in the circumferential direction is formed between adjacent projections 116. This space P forms a communication passage for communicating the space on one side (upper side in FIG. 6) of the damper mechanism 9 with the space on the other side (lower side in FIG. 6), and functions as a flow path that allows the fuel inside the damper chamber 10 to circulate to both surfaces of the main body portion 91 of the damper mechanism 9. The length of each of the projections 116 can be set to be short as long as cutting and raising is possible. Even in a case where the length of the projections 116 is made as short as possible, the space P as a flow path can be always secured between the adjacent projections 116, so that the cover-side holding member 9*a* can be minimized in the radial direction.

The body-side holding member 9*b* is, for example, an elastic body having a cylindrical and rotationally symmetric shape as illustrated in FIG. 6 (see also FIGS. 7 and 8 described later). Specifically, the body-side holding member 9*b* is configured by a cylindrical second side wall surface portion 121 whose one side expands in diameter, and an annular pressing portion 122 bent radially inward from an opening end on the small diameter side of the second side wall surface portion 121, and an annular flange portion 123 protruding radially outward from an opening end on the large diameter side of the second side wall surface portion 121. The body-side holding member 9*b* is formed, for example, by pressing a steel plate.

In the second side wall surface portion 121, a plurality of third communication holes 121*a* are provided at intervals in the circumferential direction. The third communication hole 121*a* is a communication passage that communicates with a space (a space surrounded by the body-side holding member 9*b*, the damper mechanism 9, and the concave portion 1*p* of the body 1) formed radially inside the cylindrical second side wall surface portion 121 and a space (a space surrounded by the body-side holding member 9*b* and the damper cover 14) formed radically outside the second side wall surface portion 121, and functions as a flow path that allows the fuel of the damper chamber 10 to circulate to both surfaces of the main body portion 91 of the damper mechanism 9.

The pressing portion 122 is configured to press the flat plate portion 93 of the damper mechanism 9 over the entire circumference, and is formed to have substantially the same diameter as the pressing portion 122 of the cover-side holding member 9*a*. That is, the pressing portion 122 of the body-side holding member 9*b* and the pressing portion 112 of the cover-side holding member 9*a* are configured to interpose both surfaces of the flat plate portion 93 of the damper mechanism 9 in the same manner.

The flange portion 123 is configured to abut on the end surface 1*s* of the body 1 on the side of the concave portion 1*p*. In addition, the flange portion 123 is configured to face the inner peripheral surface of the large-diameter cylindrical portion 143 of the damper cover 14 with a gap (third gap) within a predetermined range, and functions as a third regulation portion that regulates movement of the body-side holding member 9*b* in the radial direction in the damper chamber 10. In other words, the flange portion 123 has a function of centering the body-side holding member 9*b* inside the damper cover 14. The third gap between the outer peripheral edge of the flange portion 123 and the inner peripheral surface of the large-diameter cylindrical portion 143 of the damper cover 14 is set in a range where the pressing portion 122 of the body-side holding member 9*b* does not abut on the welding portion 92 of the damper mechanism 9 even if the body-side holding member 9*b* is displaced in the radial direction with respect to the damper cover 14 by the third gap.

However, even if the dimensions are set so that the pressing portion 122 of the body-side holding member 9*b* does not abut on the welding portion 92 of the damper mechanism 9, there is a possibility that the body-side holding member 9*b* deforms in the radial direction and contacts the damper mechanism 9 during assembly. In order to avoid this, in this embodiment, as illustrated in FIG. 7, the body-side holding member 9*b* includes a bottom surface (flange portion 123) in contact with the body 1 and a flexible portion 124 which is urged downward from the damper cover 14 toward the body 1 to be formed along an urging direction.

More specifically, the body-side holding member 9*b* includes a bottom surface 123 in contact with the body end surface is and a bent portion 124 (flexible portion) which is located on the inner diameter side with respect to the bottom surface 123 and is formed bent toward the body 1 with respect to a contact portion s between the body end surface is and the bottom surface 123. As a result, the cover-side holding member 9*a* is urged by the damper cover 14, so that when the body-side holding member 9*b* is urged, the deformation in the radial direction is reduced and the bending is made in the axial direction. Therefore, it is possible to prevent the pressing portion 122 of the body-side holding member 9*b* from being greatly deformed in the radial direction and coming into contact with the welding portion 92 of the damper mechanism 9.

In this case, the body-side holding member 9*b* has a body-side holding side surface portion 121 that is connected to the bent portion 124 and faces the damper mechanism 9 side with respect to the contact portion s between the body 1 and the bottom surface 123. Further, it is desirable that the radial length of the contact portion s in contact with the body-side holding member 9*b* of the body 1 (contact width between the body and the body-side holding member 9*b* in FIG. 8) is 1.2 mm to 1.6 mm. In this case, it is desirable that the body-side holding member side surface portion 121 of the body-side holding member 9*b* is formed with a communication passage that communicates the left and right sides of the body-side holding member side surface portion 121. As a result, the lower surface of the damper mechanism can be filled with fuel, and the pressure pulsation reducing effect can be obtained. Further, it is desirable that the body 1 has the concave portion 1*p* on the side opposite to the damper mechanism 9 from the contact portion s that contacts the body-side holding member 9*b*.

Further, it is desirable that the intersection angle θa between a contact surface 112*a* between the cover-side holding member 9*a* and the damper mechanism 9 and a cover-side holding side surface 113 from the contact surface 112*a* toward the damper cover 14 is configured to be 40° to 50°.

At this time, the cover-side holding member 9*a* is configured to hold the damper mechanism by being pressed toward the damper mechanism 9 by the damper cover 14.

Further, the damper mechanism 9 is configured by joining two metal diaphragms 91 at an outer peripheral joint portion 92, and the cover-side holding member 9*a* includes a cover-side holding regulation portion 116 of which movement in the radial direction is regulated when the cover-side holding contact portion 112*a* in contact with the damper mechanism on the inner diameter side of the outer peripheral joint portion 92 comes into contact with the cover side surface 144*a* of the damper cover 14 on the outer peripheral side of the outer peripheral joint portion 92. It is desirable that the acute-angled intersection angle θb between the contact surface 112*a* and the body-side holding side surface portion 121 is larger than the acute-angled intersection angle θa between the contact surface 112*a* and the cover-side holding side surface portion 113. With this configuration, deformation in the outer diameter direction can be intentionally stopped.

At this time, it is desirable that the upper end portion 122 of the body-side holding side surface portion 121 of the body-side holding member 9*b* comes into contact with the damper mechanism 9 on the inner diameter side with respect to the outer peripheral joint portion 92. The body-side holding member 9*b* is regulated from moving in the outer diameter direction by coming into contact with the cover side surface 143*a* of the damper cover 14 on the outer diameter side of the outer peripheral joint portion 92.

Further, it is desirable that the cover-side holding regulation portion 116 of the cover-side holding member 9*a* is formed by a protruding portion 116*a* protruding toward the outer diameter side. The gap formed by the cover-side holding regulation portion 116 and the protruding portion 116*a* can be used as a fuel passage that communicates vertically.

The same effect can be obtained because a flow path can be formed even if a plurality of through holes communicating with the above and below sides of the cover side holding member 9*b* are formed in the protruding portion 116*a* of the cover-side holding member 9*a*.

In the above, the configuration in which the flexible portion 124 (bent portion) is located below the bottom surface is or the contact portion s has been described, but the invention is not necessarily limited to this positional relationship. For example, the flexible portion 124 of the body-side holding member 9*b* may be formed by a thin portion thinner than the thickness of other portions of the body-side holding member 124. However, it is desirable that the flexible portion 124 of the body-side holding member 9*b* is formed on the inner diameter side of the bottom surface is and in the downward direction of the bottom surface 1*s*.

As described above, according to this embodiment, the body-side holding member 9*b* is easily deformed in the axial direction, and the deformation in the radial direction can be suppressed. It is effective even if the amount of compression in the axial direction changes, and it is possible to give a margin to the amount of deflection at the time of assembly. Therefore, it is possible to relax the dimensions of the parts in the axial direction, and the manufacturing cost of those parts can be reduced. It is possible to reduce the manufacturing cost of the parts for holding the damper mechanism 9 and suppress the radial deformation of the damper holding members (9*a*, 9*b*) at the time of assembly.

Operation of High-Pressure Fuel Pump

When the plunger 2 moves toward the cam 81 and enters a suction stroke state while the cam 81 rotates illustrated in FIG. 2, the volume of the pressurizing chamber 11 is increased, and the fuel pressure in the pressurizing chamber 11 is lowered. If the fuel pressure in the pressurizing chamber 11 is lowered than the pressure of the suction port 31*b* in this stroke, the suction valve 30 enters an open state. Therefore, as illustrated in FIG. 5, the fuel passes through an opening 30*e* of the suction valve 30, and flows to the pressurizing chamber 11.

After the end of the suction stroke, the plunger 2 moves up to the compression stroke. Here, the electromagnetic coil 43 is kept in the non-energized state, and no magnetic urging force is generated. In this case, the suction valve 30 is maintained in the open state by the urging force of the rod urging spring 40. The volume of the pressurizing chamber 11 is reduced according to the compression movement of the plunger 2. However, in a state where the suction valve 30 is opened, the fuel once sucked into the pressurizing chamber 11 returns to the suction passage 10*d* through the opening 30*e* of the suction valve 30. Therefore, the pressure of the pressurizing chamber 11 is not increased. This stroke is called a returning stroke.

In this state, when the control signal of the ECU 27 (see FIG. 1) is applied to the electromagnetic suction valve mechanism 300, a current flows through the electromagnetic coil 43 via the terminal 46 (see FIG. 2). Then, the magnetic attraction force operates between the fixed core 39 and the anchor portion 36, so that the magnetic urging force over-comes the urging force of the rod urging spring 40 to make the rod move in a direction away from the suction valve 30. Therefore, the suction valve 30 is closed by the urging force of the suction valve urging spring 33 and the fluid force caused by the fuel flowing into the suction passage 10*d*. By closing the suction valve 30, the fuel pressure in the pressurizing chamber 11 rises in accordance with the rising motion of the plunger 2, and when the pressure becomes equal to or higher than the pressure of the fuel discharge port 12, the discharge valve 8*b* of the discharge valve mechanism 8 illustrated in FIG. 3 opens. Thereby, the high-pressure fuel in the pressurizing chamber 11 is discharged from the fuel discharge port 12 through the discharge valve chamber 12*a* and the fuel discharge passage 12*b*, and is supplied to the common rail 23 (see FIG. 1). This stroke is called a discharge stroke.

In other words, the compression stroke of the plunger 2 illustrated in FIG. 2 (the upward stroke from the lower start point to the upper start point) includes the returning stroke and the discharge stroke. In addition, the flow rate of the discharging high-pressure fuel can be controlled by controlling timing for energizing the electromagnetic coil 43 of the electromagnetic suction valve mechanism 300.

In the returning stroke, in a case where the fuel once flowing into the pressurizing chamber 11 is returned to the suction passage 10*d* again through the suction valve 30 in the open state, the fuel flows back from the pressurizing chamber 11 to the suction passage 10*d*. Therefore, pressure pulsation occurs in the damper chamber 10. The pressure pulsation is transmitted to the surface of the damper mechanism 9 disposed in the damper chamber 10 illustrated in FIG. 6 on the body 1 side (the lower side in FIG. 6), and transmitted to the surface of the damper mechanism 9 on the damper cover 14 side (the upper side in FIG. 6) sequentially through the third communication hole 121*a* of the body-side holding member 9*b*, the space P between the adjacent projections 116 of the cover-side holding member 9*a*, and the second communication hole 113*a* of the cover-side holding member 9*a*. This pressure pulsation is reduced by the expansion and contraction of the main body portion 91 of the damper mechanism 9.

In addition, as illustrated in FIG. 4, the volume of the sub-chamber 7*a* increases or decreases due to the reciprocating motion of the plunger 2 having the large-diameter portion 2*a* and the small-diameter portion 2*b*. When the plunger 2 moves down, the volume of the sub-chamber 7*a* decreases, and the fuel flows from the sub-chamber 7*a* to the damper chamber 10 via the fuel passage 10*e*. On the other hand, when ascending, the volume of the sub-chamber 7*a* increases, and the fuel flows from the damper chamber 10 to the sub-chamber 7*a* via the fuel passage 10*e*. This makes it possible to reduce the fuel flow into and out of the pump during the suction stroke or the returning stroke of the pump, and reduce pressure pulsation generated inside the pump.

Further, the invention is not limited to the above embodiments, but various modifications may be contained. The above-described embodiments have been described in detail for clear understating of the invention, and are not necessarily limited to those having all the described configurations. Some of the configurations of the embodiments may be omitted, replaced with other configurations, and added to other configurations.

REFERENCE SIGNS LIST

1 body
14 14A 14B damper cover
9 damper mechanism (metal damper)
9*a* 9*c* cover-side holding member
9*b* body-side holding member
10 low-pressure fuel chamber (damper chamber)
11 pressurizing chamber
92 welding portion
111 contact portion
111*a* first communication hole (communication hole)
112 pressing portion
113 first side wall surface portion (side wall surface portion)
113*a* second communication hole (communication hole)
115 enclosing portion (first regulation portion)
116 projection (second regulation portion)
117 flange (second regulation portion)
117*a* fourth communication hole (flow path)
123 flange portion (third regulation portion)
P space (flow path)

The invention claimed is:

1. A high-pressure fuel pump, comprising:
a damper cover that is arranged on an upstream side of a pressurizing chamber and is attached to a body to form a damper chamber;
a damper mechanism that is arranged in the damper chamber; and
a body-side holding member that holds the damper mechanism from a body side, wherein
the body-side holding member includes a bottom surface in contact with the body and a flexible portion formed along an urging direction by being urged downward from the damper cover toward the body, and
the flexible portion of the body-side holding member is formed by a thin portion thinner than thicknesses of other portions of the body-side holding member.

2. A high-pressure fuel pump, comprising:
a damper cover that is arranged on an upstream side of a pressurizing chamber and is attached to a body to form a damper chamber;
a damper mechanism that is arranged in the damper chamber; and
a body-side holding member that holds the damper mechanism from a body side, wherein
the body-side holding member includes a bottom surface in contact with the body, and a bent portion that is located on an inner diameter side with respect to the bottom surface and formed by bending toward the body with respect to a contact portion between the body and the bottom surface, and
a radial length (*seat surface width) of the contact portion in contact with the body-side holding member of the body is 1.2 mm to 1.6 mm.

3. A high-pressure fuel pump, comprising:
a damper cover that is arranged on an upstream side of a pressurizing chamber and is attached to a body to form a damper chamber;
a damper mechanism that is arranged in the damper chamber; and
a cover-side holding member that holds the damper mechanism from a damper cover side, wherein
an intersection angle between a contact surface between the cover-side holding member and the damper mechanism and a cover-side holding side surface from the contact surface toward the damper cover is 40° to 50°, and
a radial length (*seat surface width) of the contact portion in contact with the body-side holding member of the body is 1.2 mm to 1.6 mm.

4. The high-pressure fuel pump according to claim 3, wherein the cover-side holding member is pressed by the damper cover toward the damper mechanism so as to hold the damper mechanism.

5. The high-pressure fuel pump according to claim 3, wherein the damper mechanism is configured by joining two metal diaphragms in an outer peripheral joint portion, wherein the cover-side holding member includes a cover-side holding contact portion that is in contact with the damper mechanism on an inner diameter side from the outer peripheral joint portion, and a cover-side holding regulation portion that is in contact with a cover side surface of the damper cover on an outer diameter side from the outer peripheral joint portion so as to regulate movement in a diameter direction.

6. The high-pressure fuel pump according to claim 5, wherein the cover-side holding regulation portion of the cover-side holding member is formed by a protruding portion protruding toward an outer diameter side.

7. The high-pressure fuel pump according to claim 6, wherein a plurality of through holes communicating with above and below sides of the cover-side holding member are formed between the protruding portions of the cover-side holding member.

8. The high-pressure fuel pump according to claim 2, wherein the body-side holding member includes a body-side holding side surface portion that is connected to the bent portion and faces the damper mechanism side with respect to a contact surface between the body and the bottom surface.

9. The high-pressure fuel pump according to claim 2, wherein the body includes a concave portion that is recessed from the contact portion in contact with the body-side holding member to a side opposite to the damper mechanism.

10. The high-pressure fuel pump according to claim 8, wherein the damper mechanism is configured by joining two metal diaphragms at the outer peripheral joint portion, and wherein an upper end portion of the body-side holding side surface portion of the body-side holding member comes into contact with the damper mechanism on an inner diameter side with respect to the outer peripheral joint portion.

11. The high-pressure fuel pump according to claim 10, wherein the body-side holding member includes a body-side holding regulation portion that regulates movement in a radial direction by contacting a cover side surface of the damper cover on an outer side from the outer peripheral joint portion.

12. The high-pressure fuel pump according to claim 8, wherein a communication passage connecting left and right sides of the body-side holding side surface portion is formed on the body-side holding side surface portion of the body-side holding member.

13. The high-pressure fuel pump according to claim 1, wherein the flexible portion of the body-side holding member is formed on an inner diameter side of the bottom surface and in the downward direction of the bottom surface.

* * * * *